United States Patent [19]

Hellman

[11] Patent Number: 4,905,621

[45] Date of Patent: Mar. 6, 1990

[54] SAIL CHANGING CARTRIDGE

[76] Inventor: Jesse M. Hellman, 1400 Wine Spring La., Baltimore, Md. 21204

[21] Appl. No.: 305,181

[22] Filed: Feb. 2, 1989

[51] Int. Cl.[4] ..... B63H 9/10

[52] U.S. Cl. ..... 114/102; 114/105; 114/108

[58] Field of Search ..... 114/102–108, 114/113, 112

[56] References Cited

U.S. PATENT DOCUMENTS

| | | | |
|---|---|---|---|
| Re. 31,829 | 2/1985 | Stearn | 114/105 |
| 188,491 | 3/1877 | Atwood . | |
| 361,049 | 5/1887 | Campbell . | |
| 639,916 | 12/1899 | Achterberg . | |
| 1,798,772 | 3/1931 | Wood | 114/112 |
| 2,240,878 | 5/1941 | Andresen | 114/102 |
| 2,699,136 | 1/1955 | Duerr | 114/102 |
| 2,925,798 | 2/1960 | Colgate | 114/102 |
| 3,006,308 | 10/1961 | Enke | 114/102 |
| 3,251,329 | 5/1966 | Smith | 114/102 |
| 3,901,175 | 8/1975 | Wheatley | 114/102 |
| 4,228,755 | 10/1980 | Graham | 114/101 |
| 4,340,005 | 7/1982 | Lagerquist | 14/105 |
| 4,474,127 | 10/1984 | Stevenson, IV | 114/105 |
| 4,619,216 | 10/1986 | Crear, III et al. | 114/105 |

FOREIGN PATENT DOCUMENTS

| | | | |
|---|---|---|---|
| 962531 | 2/1975 | Canada | 114/113 |

OTHER PUBLICATIONS

Advertisement for Hood Reefing and Furling System, Sail Magazine, Dec., 1988.

Advertisement for Harkin Reefing and Furling System, Sail Magazine, Dec. 1988.

*Primary Examiner*—Sherman D. Basinger

*Attorney, Agent, or Firm*—Semmes, Bowen & Semmes

[57] ABSTRACT

A sail changing system wherein the sail is controlled by slides which are attached to the lufftape by short cords, which slide along beside the lufftape in a grooved track on the foil when the sail is raised, and which feed into a cartridge when the sail is lowered.

1 Claim, 8 Drawing Sheets

SAIL CHANGING CARTRIDGE

TECHNICAL FIELD OF THE INVENTION

The present invention has its most important application to changing sails, particularly foresails, on vessels using roller furling systems.

BACKGROUND OF THE INVENTION

Currently, the leading edge (luff) of most sails is supported in one of three ways: (1) by clips (hanks) which attach to a wire; (2) by slides sewn to the luff which are then held in a grooved track or (3) by a lufftape which is sewn to the luff and fed into a long, grooved metal strip (the foil). Sails which use the third method have the considerable advantage of presenting a straight, aerodynamically efficient leading edge, but they have one significant problem: when the sail is lowered and the lufftape comes out of the groove, the sail comes down in a disorganized heap on the deck. When this happens, the sail is difficult to control on anything other than light winds. Unless the boat has sufficient crew, it can be very difficult to fold the sail and get it out of the way so that a different sail can be put up. The sail cartridge system I have devised is an effort to solve this problem.

SUMMARY OF THE INVENTION

The sail cartridge system I have devised, which I call the LufCord Cartridge System, consists of a series of small slides (which are attached to the lufftape by a means of short cords). These slides move along a second groove in the foil which is parallel to the one containing the lufftape. The cords are long enough so that they take no load or strain until the sail is lowered. This design is compatible with most modern headfoils (the aluminum extrusion containing the groove for the headsail lufftapes), as these foils are generally manufactured with two parallel grooves. When the sail is lowered, the slides feed into a cartridge at the base of the foil. As the sail is lowered and the lufftape exits its groove, the slides hold the sail and cause it to fold up in an orderly way. When the sail is fully lowered and all of the slides are in their cartridge, the sail is rolled up and bagged, the cartridge is removed from its position, and the second sail is attached by means of its own cartridge.

The advantages of this system are significant. First, the sail is controlled by the cords, and is manageable by a single person even in high winds. Second, the cords cause the sail to fold in an orderly way as it is taken down, so that it is easy for one person to roll the sail into a compact bundle and stow it out of the way. Third, as the lufftape is held at the foil as the sail is raised, the lufftape is less likely to be blown out of position and to jam when the sail is raised.

BRIEF DESCRIPTION OF THE DRAWINGS

FIGS. 9 through 13 depict cross sectional views of the indicated points on FIG. 8, clearly showing the groove ("17") in the cartridge unit ("C"). FIG. 14 depicts the cartridge unit ("13") securely attached to the lower portion of the headfoil ("2") by means of a ridged protrusion ("11") and aligned and locked against the portion at the headfoil ("4") which would hold the sail by means of a locking collar ("20").

FIGS. 16 through 22 show an alternative method for locking the cartridge unit into place, by means of hooks ("26"). FIG. 16 shows the cartridge as it would appear in place, with a slide latch ("23") which, when raised, would securely anchor the cartridge by means of the hooks shown in FIG. 22 ("26"). FIGS. 17A, 17B, 18, 19, 20 and 23 depict cross sections of this design at the points indicated.

FIG. 26 depicts the cartridge unit in place; FIGS. 27 and 28 depict cross sections of FIG. 26 at the indicated points.

DESCRIPTION OF EXEMPLARY FORMS OF THE INVENTION SHOWN IN THE DRAWINGS

Figure 1:
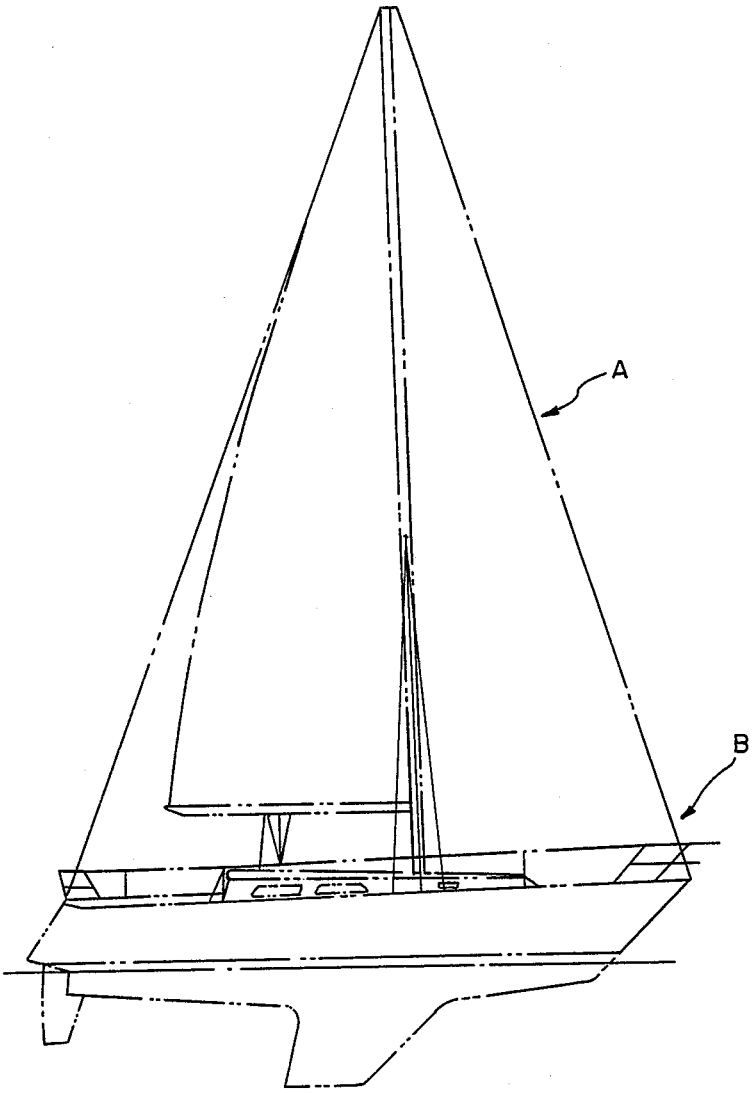
FIG. 1 shows a typical small sailboat with a foresail ("A") and a mainsail. The location of the cartridge unit in the instant invention would be at the base of the headfoil ("B").
Figure 2:
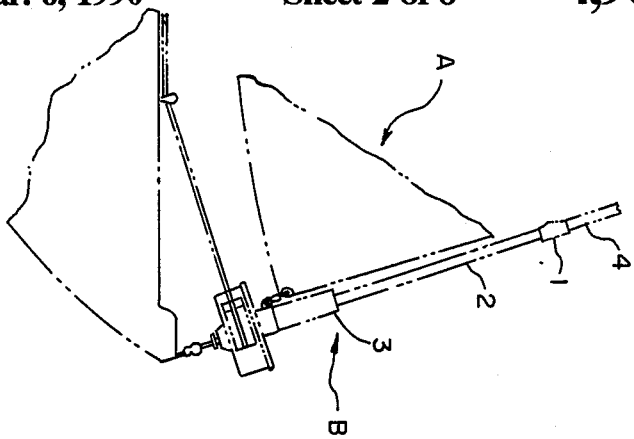
FIG. 2 depicts a typical roller furling system of the type now generally in use, wherein the foresail ("A") is attached at its base to a spool device ("3"). The leading edge of the sail is guided into a groove on the headfoil ("2") by means of a guide ("1"); above the guide the lufftape of the sail would be within the groove on the headfoil. Once the sail is raised, it can be easily furled and unfurled by rotating the spool ("3") at the base of the headfoil.

The essential idea of the invention, a sail changing system wherein the sail is controlled by slides which are attached to the lufftape by short cords which slide along beside the lufftape in a grooved track on the foil and which feed into a cartridge when the sail is lowered can be accomplished in a number of ways, the preferred methods being as shown in the drawings. The principal variations relate to the manner in which the cartridge is anchored to the foil.

Figure 3:
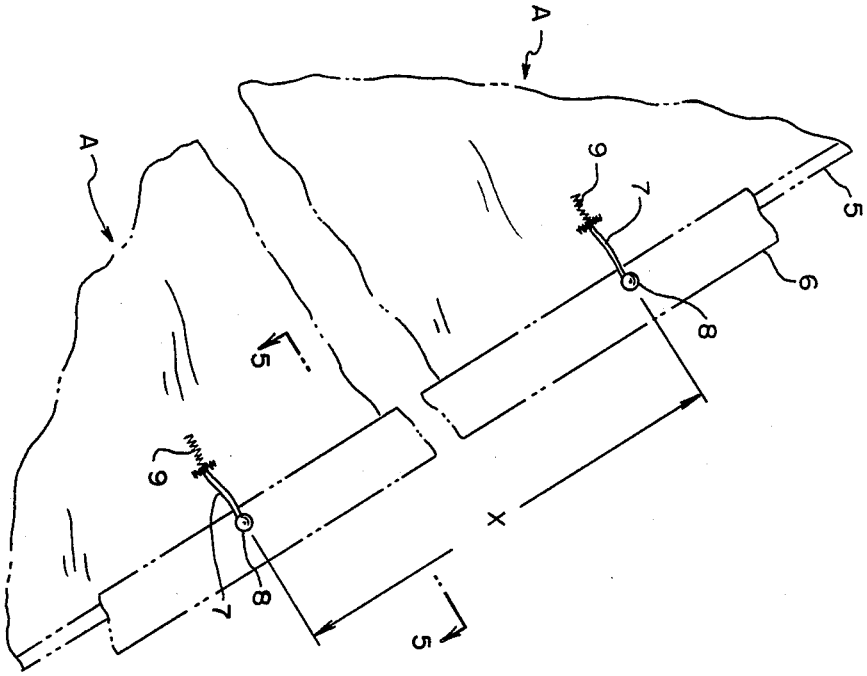
FIG. 3 depicts the sail ("A") of this invention with the short cords ("7") and slides ("8") attached ("9") to the sail. The distance ("X") from cord to cord varies with the size of the sail but would ordinarily be approximately two to three feet. Figure three also shows a closeup of the lufftape ("5") and headfoil ("6").
Figure 4:
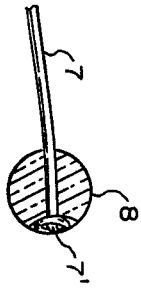
FIG. 4 depicts a close view of the slide ("8") and cord ("7") used in the instant invention.
Figure 7:
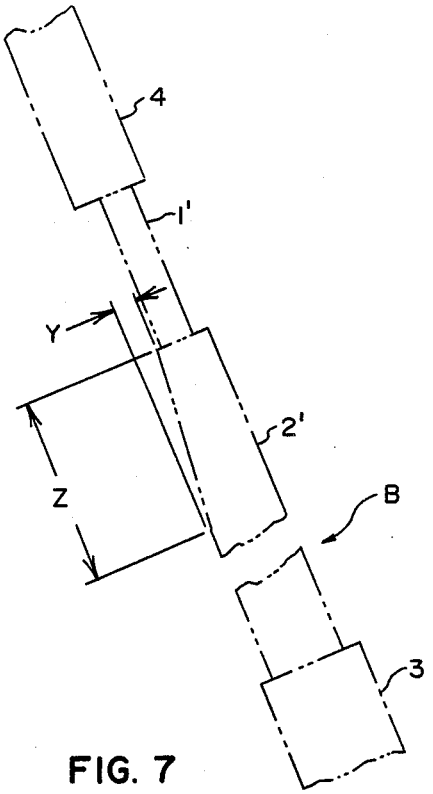
FIG. 7 shows the headfoil of FIG. 6 as modified to accommodate the cartridge unit of the instant invention.
Figure 5:
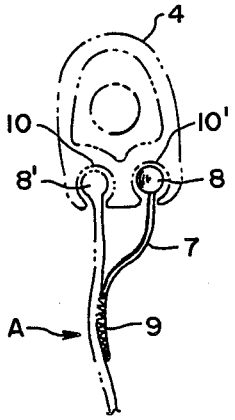
FIG. 5 depicts a cross section of the headfoil ("4") shown in FIG. 3 depicting the parallel grooves ("10'"), one holding the lufftape ("8'") of the sail and the other holding the slide ("8") attached by ("9") by a cord ("7") to the sail ("A").
Figure 6:
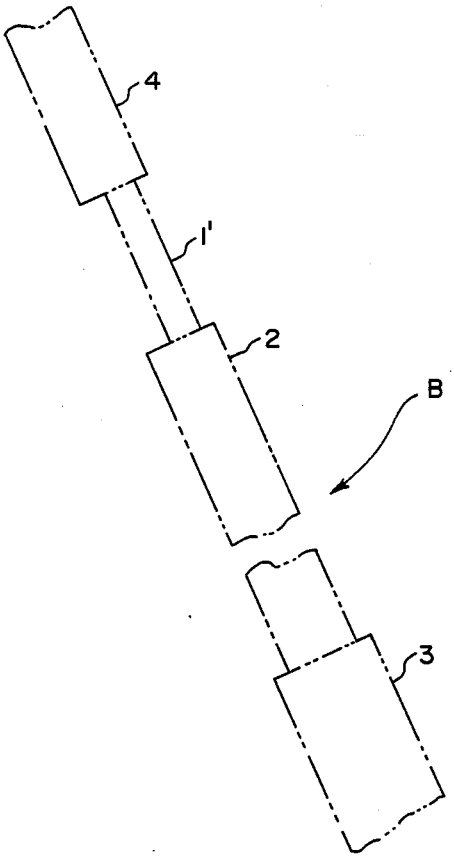
FIG. 6 depicts the structure of the lower portion of a typical headfoil ("B"). Referring back to FIG. 2, the top of the spool is depicted at "3," the portion of the headfoil which does hold the sail is shown at "2," the point at which the guide unit is mounted on the headfoil is shown at "1'," and the portion of the headfoil which holds the sail is shown at "4."
Figure 11:
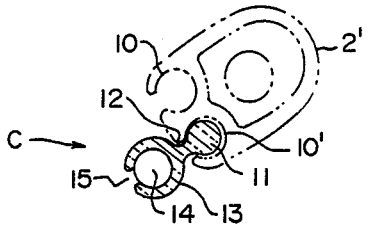
FIGS. 8 through 14 depict the preferred form of the cartridge unit ("C"), which is made of a flexible material which slides into the groove in the lower portion of the headfoil ("B"), above the top of the spool ("3") and below the guide unit location ("1'"). This cartridge unit contains a groove to receive the slides from the groove in the upper portion of the headfoil ("4") when the sail is lowered.
Figure 12:
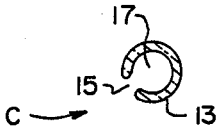
Figure 10:
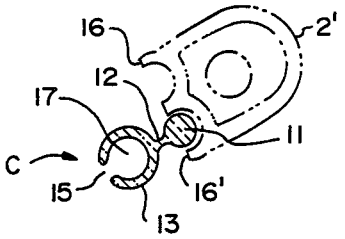
Figure 13:
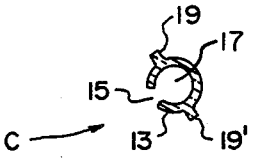
Figure 9:
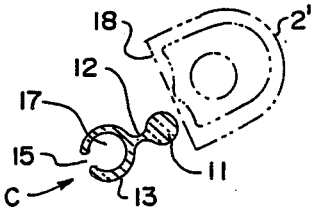
Figure 8:
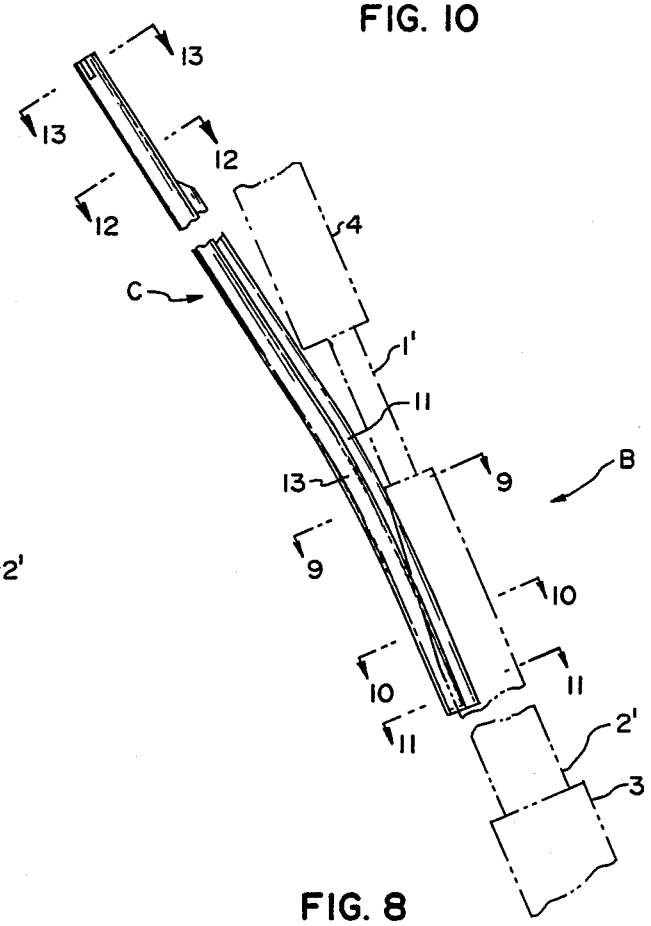
Figure 21:
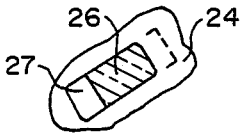
Figure 23:
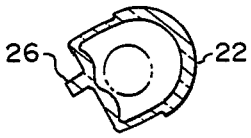
Figure 18:
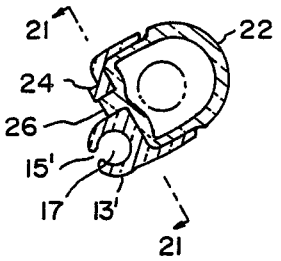
Figure 16:
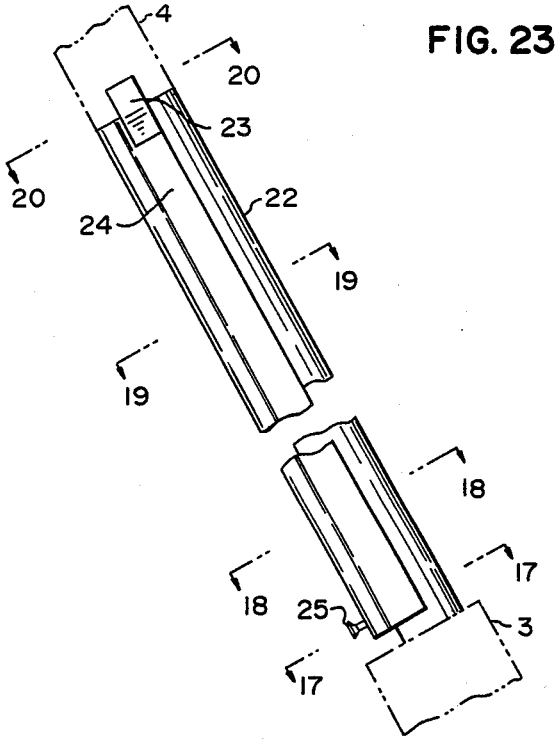
Figure 14:
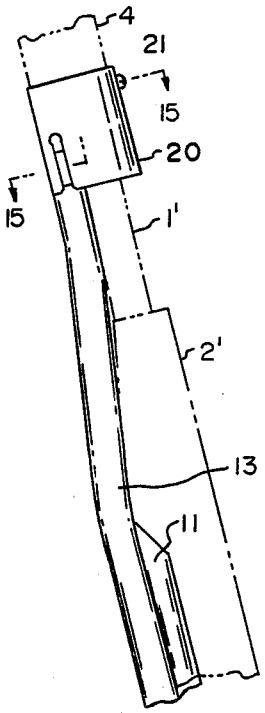
Figure 15:
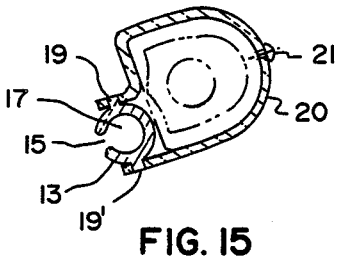
FIG. 15 shows a cross section of the locking collar of FIG. 14. With the cartridge securely abutted and aligned with the slide groove of the headfoil (see FIG. 5, location 8 supra) the cartridge is ready to receive the slides.
Figure 17B:
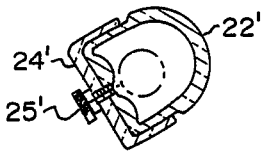
Figure 20:
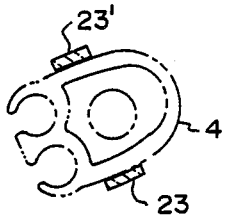
Figure 17A:
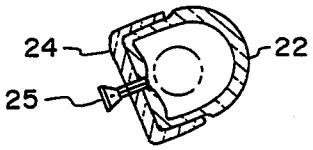
Figure 22:
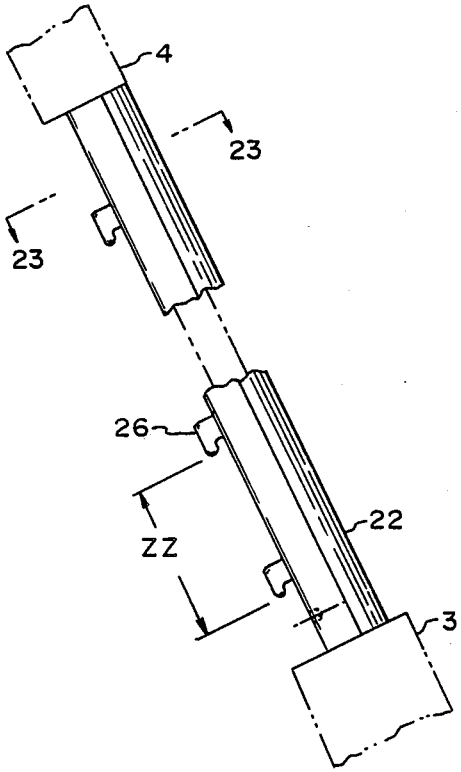
Figure 19:
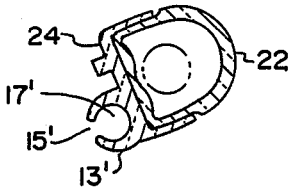
Figure 24:
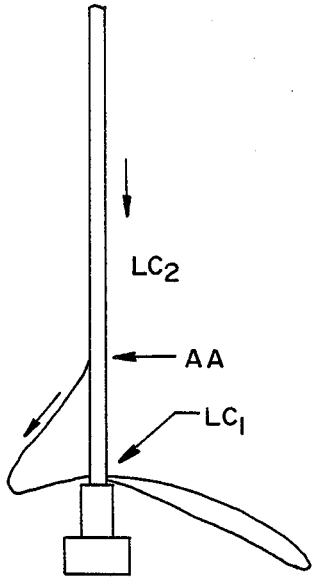
FIGS. 24 and 25 show graphically how a sail using the instant invention automatically folds or "flakes" when lowered. "AA" represents the point at the top of the cartridge where the sail leaves the groove, and is held only by the slide and cord ("LC"). This automatic folding is one of the major benefits of the instant invention.
Figure 25:
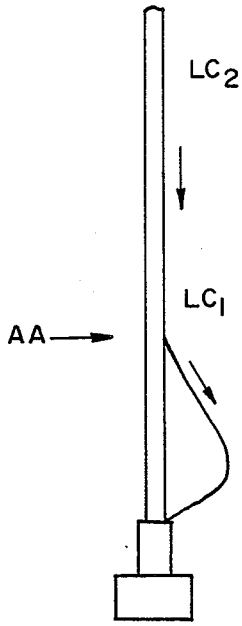

All of the preferred forms of the invention depicted in drawings have small cords sewn onto the edge of the sail at regular intervals, generally approximately two feet, although this may vary with the length of the sail as shown in FIG. 3. In the preferred forms of the invention, these cords are made of strong Dacron, and the slide at the end is made of a hard Dacron or plastic material and is half-shaped. The slide is attached to the Dacron cord by threading the Dacron cord through a hole in the slide and heating and flaring the end of the Dacron cord to prevent the slide from becoming detached. Alternatively, the slide is attached to the Dacron cord by means of a wire loop.

Assuming a foil which furls by turning clockwise, the sail's lufftape is inserted into the port groove while the slides used the starboard groove. The cords are just long enough so that they take no load or strain until the sail is lowered and the lufftape exits its groove.

The groove containing the slides continues past the feeder exit where the lufftape exits its groove. The groove containing the slides feeds into a cartridge (i.e. a removable groove), which is essentially the aft section of a short piece of foil, with the bottom closed and a cap for the top. Therefore, as the sail is lowered and the lufftape exits its groove, the sail is contained by means of the slides which are in the cartridge. A this point, when the sail is lowered and the slides are in the cartridge, the luff cords hold and control the sail. When all the slides are in their cartridge, the cartridge can be removed from its position and a second sail attached by means of its own cartridge.

Figure 28:
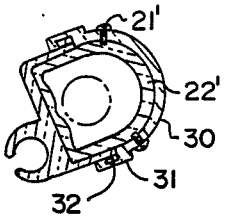
FIGS. 26 through 28 depict a third method for holding the cartridge in place, raised protrusions ("32") which slide under clips ("31") and are held in position by a small clevis pin ("25").
Figure 27:
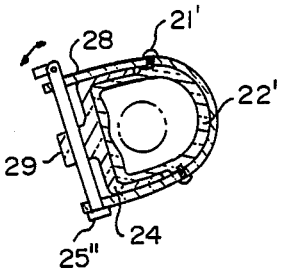
Figure 26:
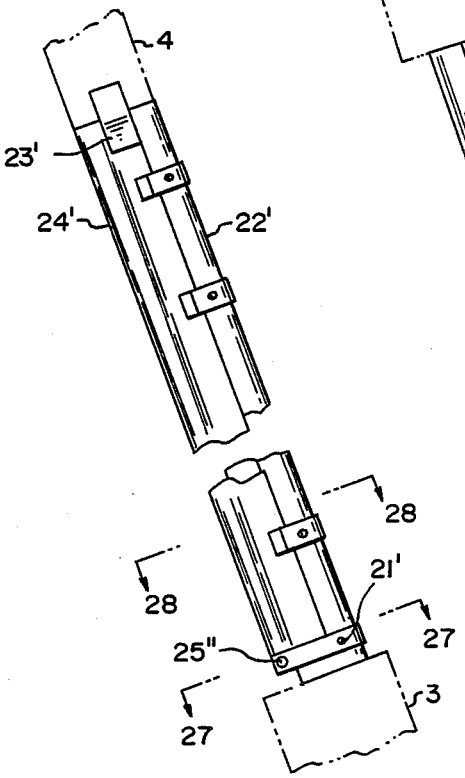
Figure 26A:
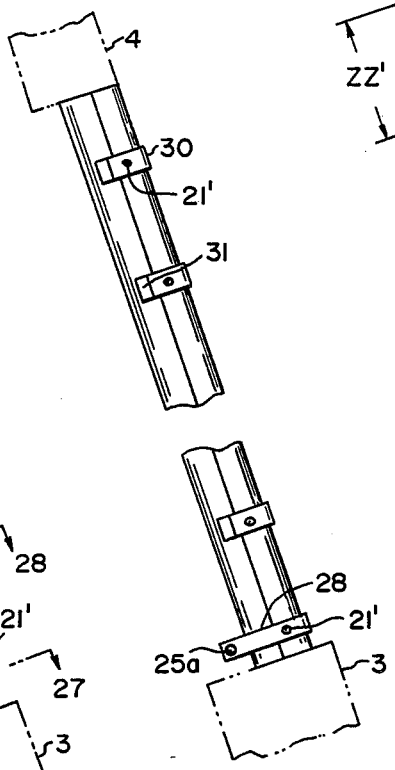
FIG. 26A depicts the headfoil without the cartridge unit.
Figure 26B:
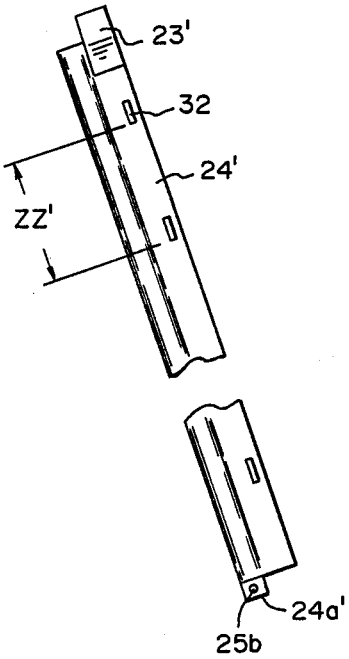
FIG. 26B depicts the cartridge unit alone.

There are numerous methods for attaching and detaching the cartridge. Three are shown in the drawings submitted herewith. The first method involves sliding a cartridge made of a flexible plastic which slides into the groove at the base of the foil and is then anchored by means of a collar. See FIGS. 8 through 15. This method is preferred for small boats. The second method of anchoring the cartridge is depicted in FIGS. 16 through 22. This method involves anchoring the cartridge in place by use of a hook and latch. In the third method the cartridge is anchored to the foil by means of raised protrusions which slide under clips and are held in place by a clevis pin. See FIGS. 26 through 28.

I claim:

1. A sail changing system comprising:

(a) a sail with a fore and aft edge;

(b) lufftape sewn into said sail's fore edge;

(c) a series of slides, each attached separately behind the fore edge of the sail at intervals by means of cords;

(d) a foil containing two parallel grooves, one groove to hold the lufftape and the other to hold the slides, such that the lufftape and the slides can move freely along their respective grooves and such that when the sail is lowered the lufftape leaves its groove;

(e) a container attached to the base of the foil into which the slides feed when the sail is lowered and the slides leave the slide groove; and (f) a means for quickly attaching and detaching the container from the foil.

* * * * *